US008745956B2

(12) United States Patent
Wang et al.

(10) Patent No.: US 8,745,956 B2
(45) Date of Patent: Jun. 10, 2014

(54) ASYMMETRIC INTEGRAL LIFTING CONSTRUCTION METHOD

(71) Applicants: Guangzhou Construction Engineering Co., Ltd, Guangzhou (CN); Shanghai YeSheng Mechanical & Electrical Control Technology Co., Ltd, Shanghai (CN)

(72) Inventors: Long Wang, Guangzhou (CN); Junyue Gao, Guangzhou (CN); Zhenying Chen, Guangzhou (CN); Wei Wei, Shanghai (CN)

(73) Assignees: Guangzhou Construction Engineering Co., Ltd., Guangzhou (CN); Shanghai YeSheng Mechanical & Electrical Control Technology Co., Ltd., Shaghai (CN)

( * ) Notice: Subject to any disclaimer, the term of this patent is extended or adjusted under 35 U.S.C. 154(b) by 0 days.

(21) Appl. No.: 13/939,749

(22) Filed: Jul. 11, 2013

(65) Prior Publication Data

US 2014/0017059 A1 Jan. 16, 2014

(30) Foreign Application Priority Data

Jul. 12, 2012 (CN) ..... 2012 1 0245274

(51) Int. Cl.
*E04B 1/00* (2006.01)

(52) U.S. Cl.
USPC ..... 52/741.1; 52/122.1

(58) Field of Classification Search
USPC ..... 52/122.1, 125.1, 125.2, 126.1, 741.1, 52/745.2, 747.1
See application file for complete search history.

(56) References Cited

U.S. PATENT DOCUMENTS

| | | | | |
|---|---|---|---|---|
| 7,421,770 | B1 * | 9/2008 | Winter | 29/402.08 |
| 2003/0079436 | A1 * | 5/2003 | Manfre | 52/745.2 |
| 2006/0207214 | A1 * | 9/2006 | Keilaf | 52/745.2 |
| 2014/0053475 | A1 * | 2/2014 | Siqueiros | 52/125.1 |

FOREIGN PATENT DOCUMENTS

| | | | |
|---|---|---|---|
| CN | 101852019 | A | 10/2010 |
| CN | 101939493 | A | 1/2011 |

* cited by examiner

*Primary Examiner* — Brian Glessner
*Assistant Examiner* — Brian D Mattei
(74) *Attorney, Agent, or Firm* — Muncy, Geissler, Olds & Lowe, P.C.

(57) ABSTRACT

A method for lifting an asymmetric integral construction is provided, including the steps of determining proper lifting points on a construction to be lifted according to the position relationship between the construction and a base supporter, setting a dragging point on the bottom of the construction, the dragging point being located on the extension line of the connection between the gravity center of construction and the centroid of the lifting points, determining a projection point of the dragging point on the ground, arranging a dragging device between the dragging point and the projection point, installing a lifting system at a proper position, conducting lifting operation by means of the lifting system cooperated with the dragging device, and rectifying and fixing the construction after it is in place.

9 Claims, 4 Drawing Sheets

ASYMMETRIC INTEGRAL LIFTING CONSTRUCTION METHOD

FIELD OF TECHNOLOGY

The present invention relates to a lifting construction method, in particular a method for lifting an integral construction used in architectural filed when the centroid of the lifting points is eccentric from the gravity center of the construction.

BACKGROUND OF THE INVENTION

The modern architecture is being designed higher, larger, newer and stranger for the purpose of artistic performance and visual perception. Specifically, it is more and more popular to use decorative or functional ceilings on top of the building. With respect to superstructure of the ceiling, its lower supporting points are usually irregular and asymmetrical, however such structure brings a greater challenge during construction. In this case, if an integral lifting method was used during construction, the centroid of the lifting points will be greatly eccentric from the gravity center of the construction due to the difficulty of setting the proper lifting points thereon. Sometimes such integral lifting method cannot be used due to the gravity center of the construction being out of the extent surrounded by the lifting points, and a high-altitude piecemeal assemble method is mainly used, but with the following disadvantages:

(1) A massive high-altitude workload, a difficulty of safety protection and high safety risk;

(2) Unsteady construction quality due to bad high-altitude welding condition;

(3) Long working period on site due to the above disadvantages.

SUMMARY OF THE INVENTION

There is an object to provide a method for asymmetric lifting integral construction with safety, economy, steadiness and short working period on site.

The method for lifting asymmetric integral construction according to the present invention comprises the following steps:

1. determining proper lifting points on a construction to be lifted, according to the position relationship between the construction and a base supporter, with the following rules:

i. Said lifting points must surround most of plane extent of the construction;

ii. The eccentricity between the centroid of the lifting points and the gravity center of the construction must be minimized.

Said centroid of the lifting points means the centroid of the polygon constituted by all lifting points;

2. setting a dragging point on the bottom of the construction, and the to dragging point is located on the extension line of the connection between the gravity center of the construction and the centroid of the lifting points;

3. determining a projection point of the dragging point on the ground;

4. arranging a dragging device between the dragging point and the ground projection point, so as to ensure the stability during asymmetric construction lifting in is unexpected conditions like non-synchronization or wind load;

5. installing a lifting system at a proper position;

6. conducting lifting operation by means of the lifting system cooperated with the dragging device;

7. rectifying and fixing the construction after it has been lifted and is in right position.

If the centroid of the lifting points is slightly eccentric from the gravity center of the construction, and the construction is not so heavy, then the dragging device can be a downward rope from the dragging point.

Alternately the dragging device can be a pulley dragging system.

A fixed pulley dragging system can be used if the required dragging force was not too much, whilst the downward dragging force needs to convert to a horizontal dragging force.

But movable pulley dragging system should be used if more dragging force is required, since the system can save energy consumption, and convert dragging direction on demands.

Further improvement of said method comprises a horizontal rectifying step, that is, estimating the height of the lifting system being installed and the restoring force of the construction being lifted when the horizontal shift deviation of the construction exist before the lifting operation, according to the statics equilibrium principle, and then arranging a corresponding horizontal rectifying device according to foresaid data, so as to conduct horizontal rectifying operation during lifting.

The horizontal rectifying operation device can be a lifting jack, an electric hoist or a manual stay hook. Proper rectifying devices can be selected according to the magnitude of the rectifying force.

The lifting system comprises a lifting frame, a hydraulic pump source system disposed on the lifting frame, a hydraulic lifting machine connected with the hydraulic pump source system via a hydraulic oil line, and a steel strand disposed on the hydraulic lifting machine for lifting the construction.

Moreover, the lifting system further comprises sensors which are disposed on the hydraulic lifting machine, to monitor the lifting synchronism of all lifting points during the integral construction lifting.

Method for lifting asymmetric integral construction according to the present invention disposes a dragging device in the proper position, such that the integral construction can be lifted when the centroid of the lifting points is greatly eccentric from the gravity center of the construction. This method can avoid too much high-altitude installation work, with short working period. Since it doesn't need plenty of high-altitude welding, in other words, the welding can be done in advance in good ground conditions, so that the quality of the construction can be ensured, and the possible risk of high altitude work can be greatly reduced.

DETAILED EMBODIMENTS

The present invention will be further described in detail hereinafter with reference to accompanying drawings.

A method for lifting asymmetric integral construction according to the present invention comprises the following steps:

1. determining proper lifting points on an asymmetric construction.

Figure 1:
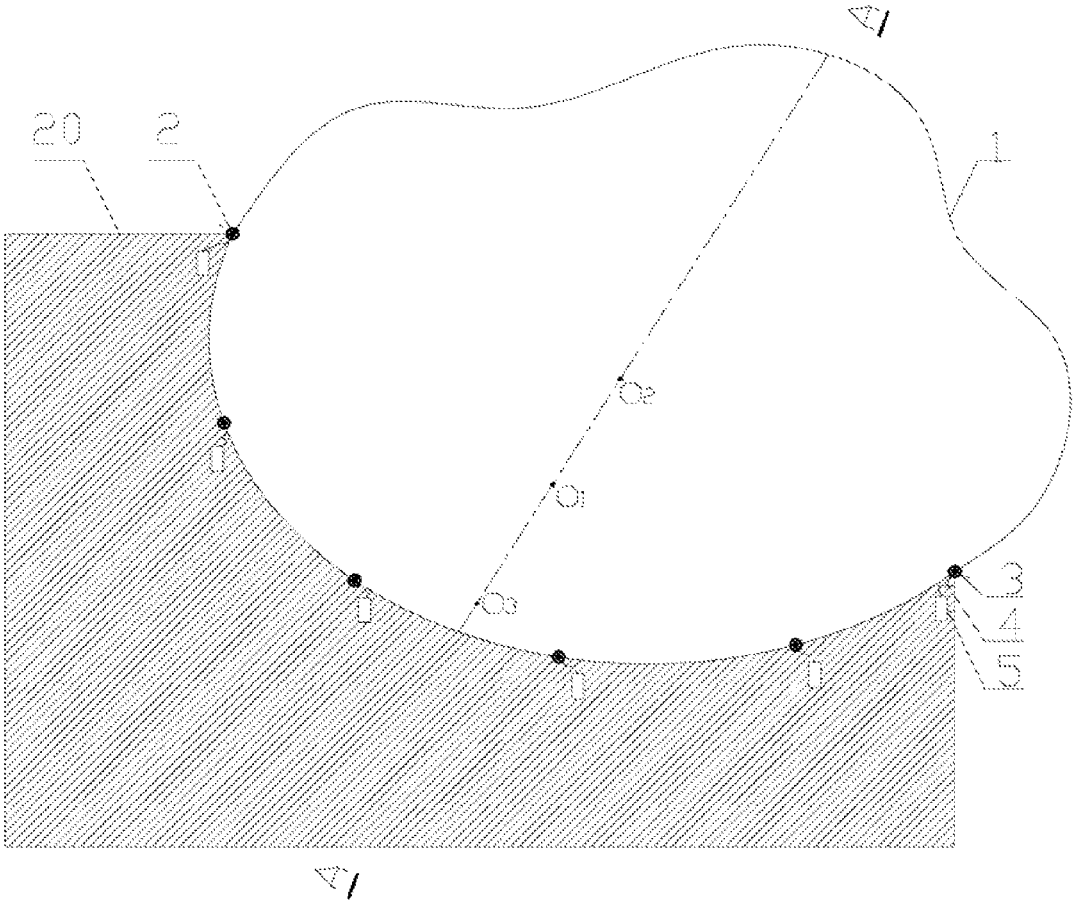
FIG. 1 is a plan sketch of an embodied construction where its centroid of lifting points is greatly eccentric from its gravity center.

FIG. 1 is a plan sketch of an embodied construction where its centroid of the lifting points is greatly eccentric from its gravity center. The proper lifting points must be determined according to the position relationship between construction 1, which is to be lifted, and its base supporter 20. The proper lifting points can be determined with the following rules:

i. Said lifting points can surround most of plant extent of the construction;

ii. The eccentricity between the centroid of the lifting points and the gravity center of the construction can be minimized.

Some planning lifting points 2 on the construction 1 are shown in FIG. 1.

Figure 2:
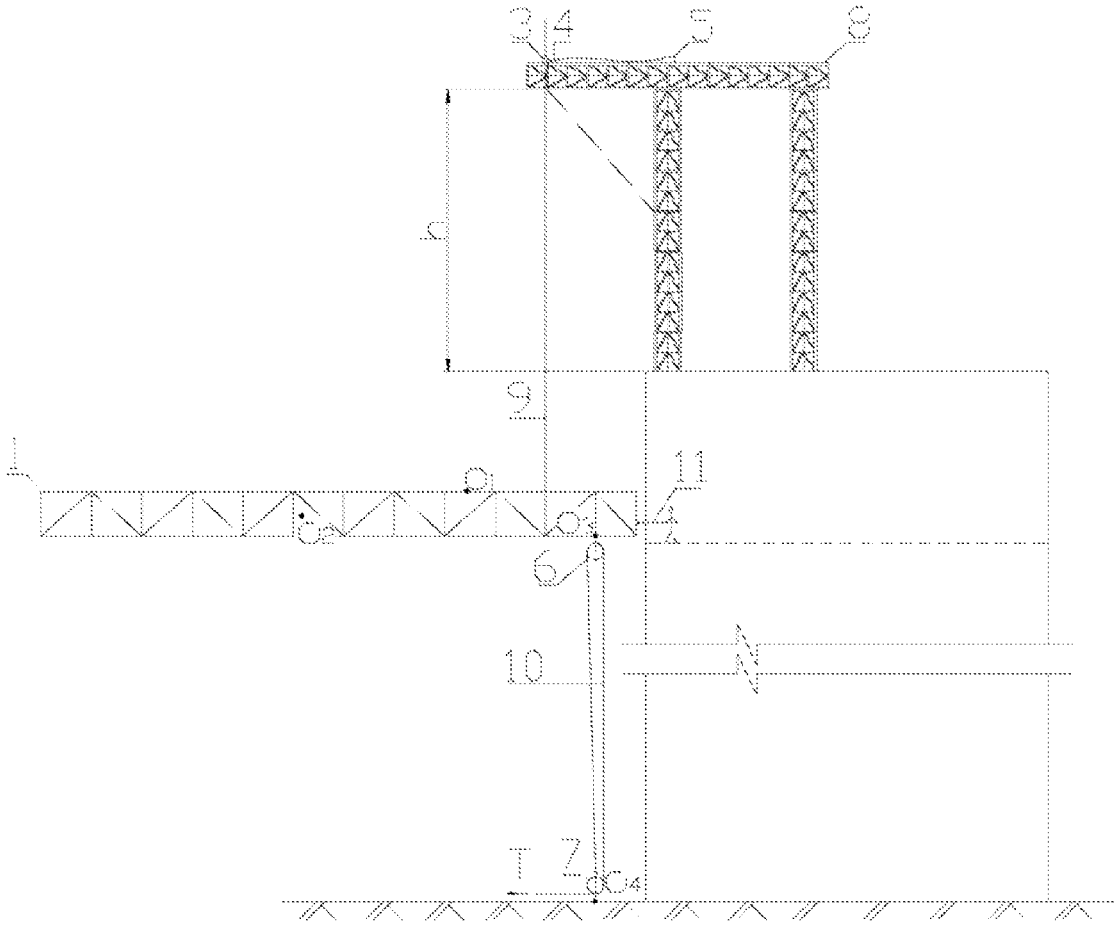
FIG. 2 is a schematic diagram of the lifting system where the construction is lifted in place.

2. As shown in FIG. 2, a dragging device, like a pulley system or dragging rope, can be arranged in order to ensure the stability during the asymmetric construction lifting in unexpected conditions like non-synchronization or wind load, by the following steps:

a) Finding the centroid of the lifting points $o_1$ of the construction 1 and the gravity center $o_2$ of the construction 1 using a mathematical method;

b) setting a point $o_3$ on the bottom surface of the construction 1, this point $o_3$ is located on the extension line of points $o_2$ and $o_1$, and setting a point $o_4$ on the ground, this point $o_4$ is the projection of point $o_3$ on the ground;

c) arranging pulleys 6 and 7 at the points $o_3$ and $o_4$ respectively.

d) arranging a dragging rope 10 to ensure the stability of the construction 1 during lifting. One end of the dragging rope 10 is fixed at point $o_4$ where the fixed pulley 7 is also installed, and the other end as a dragging end enwinds successively the pulleys 6 and 7.

If a force T is applied to the dragging end, and a balance load of 2T will be produced at the point $o_3$.

If the centroid of the lifting points centroid is slightly eccentric from the gravity center of the construction, and the construction is not so heavy, a downward dragging rope can also be arranged at the point $o_3$.

A fixed pulley dragging system can be used if the required dragging force was not too much, whilst the downward dragging force needs to convert to a horizontal dragging force. This system is very simple, so it will not be described in detail here.

But movable pulley dragging system should be used if more dragging force is required, since the system can save energy consumption, and can convert dragging direction on demands. This system is very common, so it will also not be described in detail here.

3. According to static equilibrium principle, estimating the height h of the lifting frame 8 and the restoring force of the construction 1 when its horizontal deviation occurred, and determining horizontal rectifying technology measures, for example, the use of lifting jack, electric hoist, manual stay hook and the like, during lifting and placing the construction. The principle for estimating the height h and the restoring force is shown in FIG. 3, as follows:

As shown in FIG. 2, the vertical distance between the lifting point on the lifting frame 8 and the emplacement of the construction in right position is a minimum length h, i.e. h is the minimum length of the lifting steel strand 9 to the lifting frame 8 during lifting.

Figure 3:
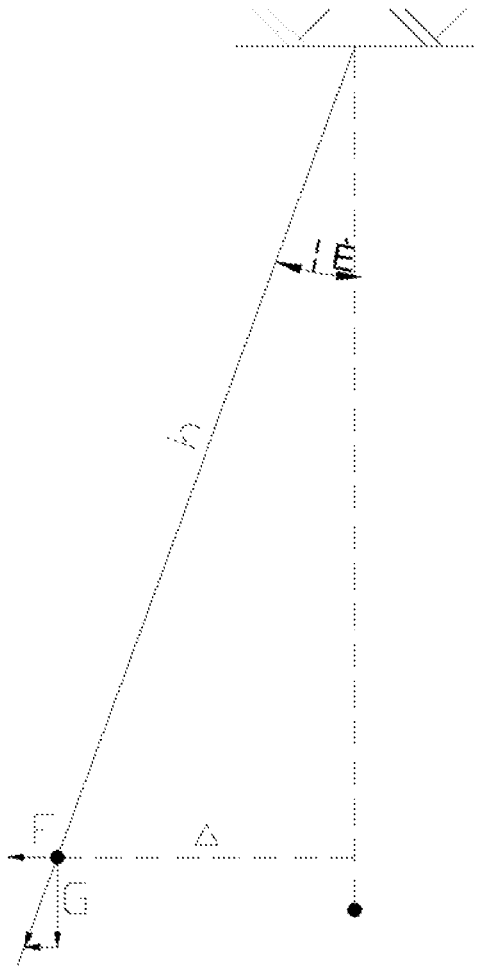
FIG. 3 is a schematic diagram of estimating and analyzing the height of the lifting frame.

As shown in FIG. 3, assuming all lifting steel strands 9 keep parallel to each other when the construction deviation occurred during lifting, and the construction can be regarded as a mass point weighed G. Again assuming the construction produced a slight horizontal deviation A, with the deviation angle θ of the lifting steel strand and the horizontal restoring force F.

In case the horizontal deviation is small, the deviation angle θ will also be small, and it makes tan θ≈sin θ

$$\text{Therefore } F = G * \tan\theta \approx G * \sin\theta = G * \frac{\Delta}{h} \tag{1}$$

Consequently, the horizontal deviation A can be defined according to working process and experiences, and then the height h of the lifting frame and the horizontal force F required can be estimated by foresaid equation (1) on the basis of the site conditions, whereby a equipment for rectifying horizontal deviation, for example lifting jack, electric hoist, manual stay hook and the like, can be selected according to the magnitude of F.

Figure 4:
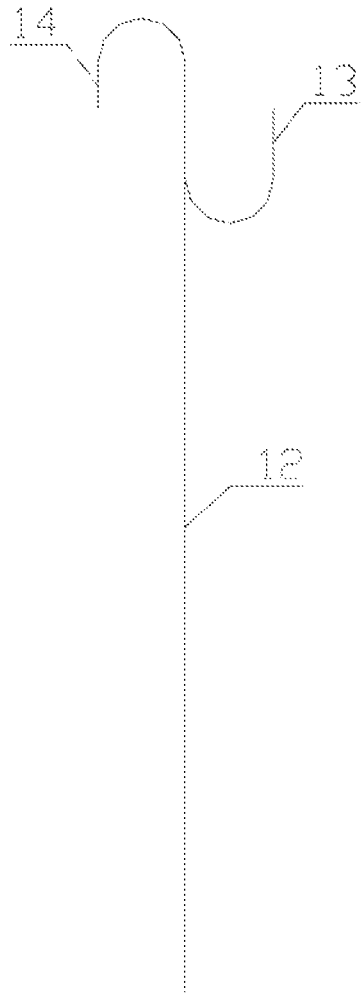
FIG. 4 is a schematic diagram of manual stay hook.

If the estimated value of F is not too large, the manual stay hook 11 of the present invention can be used to rectify horizontal deviation, as shown in FIG. 2. FIG. 4 is a schematic diagram of the manual stay hook 11, which is composed of a handle 12, a drag hook 14 for pulling in and a shoring hook 13 for pushing out.

4. According to the result of Step 3, installing the lifting frame 8 at a structure bearing. Lifting system apparatus being installed on the frame 8 comprises a hydraulic pump source system 5, a hydraulic lifting machine 3, sensors, a hydraulic oil line 4 and a steel strand 9 etc., wherein the hydraulic pump source system 5 and the hydraulic lifting machine 3 are disposed on the lifting frame 8 and connected together via a hydraulic oil line 4, and the steel strand 9 is disposed on the hydraulic lifting machine 3.

Moreover, sensors are disposed on the hydraulic lifting machine 3, so as to monitor the lifting synchronism of all lifting points during the integral construction lifting.

5. The integral construction can be lifted and dragged according to Step 2, then the horizontal deviation can further be observed and rectified according to Step 3, whereby the construction can be in place and installed, and the lifting of asymmetric construction has been done.

The examples described above are preferred embodiments of the present invention, however, it is appreciated that the skilled person in the art can make improvements and modifications within the spirit of the present invention, and these improvements and modifications are within the scope of the invention.

What is claimed is:

1. A method for lifting asymmetric integral construction, comprising steps as following:

1) determining proper lifting points on a construction to be lifted, according to the position relationship between the construction and a base supporter, with the following rules:

i. the lifting points must surround most of a plane extent of the construction;

ii. the centroid of the lifting points must be close to the gravity center of the construction;

2) setting a dragging point on the bottom of the construction, and the dragging point is located on the extension line of the connection between the gravity center of the construction and the centroid of the lifting points;

3) determining a projection point of the dragging point on the ground;

4) arranging a dragging device between the dragging point and the projection point;

5) installing a lifting system at a proper position;

6) conducting lifting operation by means of the lifting system cooperated with the dragging device;

7) rectifying and fixing the construction after it is in place.

2. The method of claim 1, wherein the dragging device is a dragging rope.

3. The method of claim 1, wherein the dragging device is a pulley dragging system.

4. The method of claim 3, wherein the pulley dragging system is a fixed pulley dragging system.

5. The method of claim 3, wherein the pulley dragging system is a movable pulley dragging system.

6. The method of claim 1, further comprising horizontal rectifying steps as following:

i. measuring the construction weight G and determining the required horizontal deviation Δ during lifting operation;

ii. estimating height h of the lifting system and restoring force F of the construction according to the equation $$F = G * \frac{\Delta}{h}$$

whereby selecting a horizontal rectifying device according to the value of the restoring force F, so as to conduct horizontal rectifying operation during lifting.

7. The method of claim 6, wherein the horizontal rectifying device is a lifting jack, an electric hoist or a manual stay hook.

8. The method of claim 1, wherein the lifting system comprises a lifting frame, a hydraulic pump source system disposed on the lifting frame, a hydraulic lifting machine connected to the hydraulic pump source system via a hydraulic oil line, and a steel strand disposed on the hydraulic lifting machine for lifting the construction.

9. The method of claim 8, wherein the lifting system further comprises sensors which are disposed on the hydraulic lifting machine.

* * * * *